US006415719B1

(12) United States Patent
Buccelli et al.

(10) Patent No.: US 6,415,719 B1
(45) **Date of Patent: *Jul. 9, 2002**

(54) SHOT CARTRIDGE WITH DOUBLE PATTERN

(75) Inventors: Paolino Buccelli, Trenzano; Walter Zanoletti, Gardone Val Trompia, both of (IT)

(73) Assignee: Muninord di Zanoletti Walter (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/524,869

(22) Filed: Mar. 14, 2000

(30) Foreign Application Priority Data

| | | |
|---|---|---|
| Mar. 16, 1999 | (IT) | BS99A000025 U |
| Aug. 5, 1999 | (IT) | BS99000077 U |
| Oct. 20, 1999 | (IT) | BS99000097 U |

(51) Int. Cl.[7] ..... F42B 7/02; F42B 7/08

(52) U.S. Cl. ..... 102/457; 102/449; 102/454; 102/532

(58) Field of Search ..... 102/448–463, 102/532

(56) References Cited

U.S. PATENT DOCUMENTS

| | | | | |
|---|---|---|---|---|
| 97,653 A | * | 12/1869 | Lancaster | 102/449 |
| 287,151 A | * | 10/1883 | Morgan | 102/462 |
| 3,352,239 A | * | 11/1967 | Schinnere et al. | |
| 3,444,777 A | * | 5/1969 | Lage | 102/453 |
| 3,614,929 A | * | 10/1971 | Herter et al. | 102/451 |
| 4,290,365 A | * | 9/1981 | Dreyer | 102/449 |
| 4,676,170 A | * | 6/1987 | Roster | 102/532 |
| 4,760,793 A | * | 8/1988 | Herring, III | 102/460 |
| 4,815,389 A | * | 3/1989 | Jakonczuk | 102/532 |
| 5,138,950 A | * | 8/1992 | Gardner et al. | 102/456 |

FOREIGN PATENT DOCUMENTS

| | | | | |
|---|---|---|---|---|
| FR | 1151613 | * | 2/1958 | 102/449 |
| GB | 9975 | * | 8/1885 | 102/532 |

* cited by examiner

*Primary Examiner*—Harold J. Tudor
(74) *Attorney, Agent, or Firm*—McGlew and Tuttle, P.C.

(57) ABSTRACT

A shotgun cartridge includes a cartridge case having a primer, a propelling charge contained in the cartridge case disposed proximate to the primer and shot. A first wad shot grouping element has a travel direction side surface in contact with the shot and extending rearwardly therefrom. The travel direction side surface acts on a first shot mass of the shot positioned in front of the first wad shot grouping element for at least some distance after exiting a barrel of a gun to define a first shot mass pattern. A second wad grouping element has a surface with a travel direction side surface and a side surface extending rearwardly from the travel direction side surface. An exterior surface with an annular edge extends forwardly of said travel direction side surface. The second wad surface acts on a second shot mass of the shot for at least some distance after exiting the barrel of the gun. The exterior surface and the travel direction side surface cooperate to form a cup shaped portion.

7 Claims, 4 Drawing Sheets

SHOT CARTRIDGE WITH DOUBLE PATTERN

FIELD OF THE INVENTION

This invention refers to shot cartridges for guns.

BACKGROUND OF THE INVENTION

Usually, these cartridges consist of a cartridge case with a primer at the base and containing a propelling charge and projectiles, consisting of lead or steel shot. However, when fired, these cartridges generally create a single pattern of shot, which disperses at a certain distance from the barrel of the gun according to the shot volume and the nature of the charge. Likewise, there has also been a proposal for shot cartridges for long distances, but these too can only produce a single pattern, albeit further from the gun.

SUMMARY OF THE INVENTION

The aim of this invention, however, is to make and supply a shot cartridge with a double pattern, that is, capable of creating two shot patterns at different distances: a first pattern at a certain distance from the gun barrel, and then a more distant pattern, once the first pattern has dispersed. In this way, the cartridge is more efficient and especially appreciated by hunters, who can hit targets at different distances.

This purpose and the advantages it brings are achieved, in accordance with the invention, by a gun cartridge that consists of a cartridge case with a primer in the base and a propelling charge. The gun cartridge includes a first mass of shot, more internal and nearer to the charge, designed to form the first pattern at a close distance, and a second mass of shot, nearer to the mouth of the cartridge case, designed to form a second pattern at a greater distance than the first. The second mass of shot is placed in a wad with its base pointing towards the gun mouth, in the direction of firing, and is designed to hold the shot during the firing and then turn over when caught by the air in order to produce the second pattern, once the first has dispersed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiments of the invention are illustrated.

DESCRIPTION OF THE PREFERRED EMBODIMENTS

Figure 1:
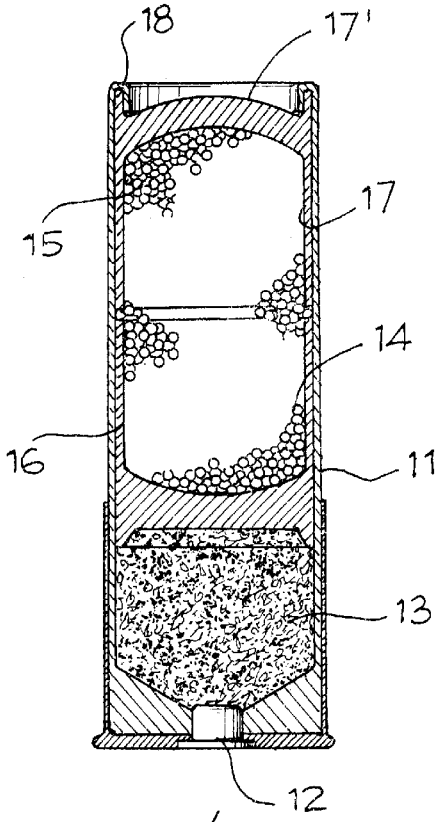
FIG. 1 is a cross-sectional view of a cartridge according to one version of the invention.

Referring to the drawings in particular, according to the version in FIG. 1, the cartridge has a cartridge case 11 with its base and primer 12. The cartridge case contains, in order from the base upwards, a propelling charge 13, a first mass of shot 14 and a second mass of shot 15. These two shot masses may be of equal or different volume, with a preference for a greater volume in the second.

Figure 2:
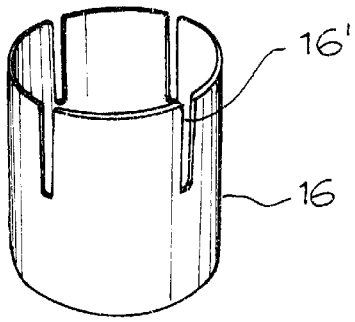
FIG. 2 is a perspective view of an example of a wad used in the cartridge in FIG. 1.

The first mass of shot 14 is placed in a first wad 16, with the form of a cup, closed at the back and open at the front in the direction of firing. Ideally, the first wad 16 has a side wall with slits 16'—FIG. 2—to assist its opening and the release of the shot 14.

Figure 3:
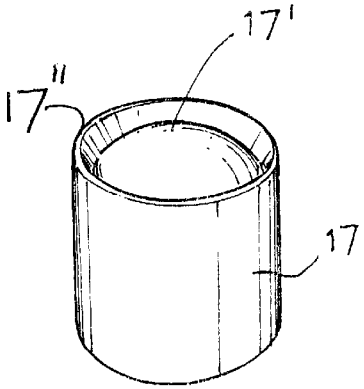
FIG. 3 is a perspective view of another example of a wad used in the cartridge in FIG. 1.

The second mass of shot 15 is placed in a second wad 17 opposite the first, that is, it is open at the back and closed by an end plate 17' that faces the firing direction. It is held in the cartridge case 11 in the traditional way by an edging 18. The second wad 17 with forward extending convex end plate 17' and forward extending annular edge 17" is shown on its own in FIG. 3. The base or end plate 17' is shaped into a dome with a convex portion extending almost fully between the annular edge 17" to cause it to turn over in flight and release the shot 15 after firing and at a certain distance from the gun barrel.

The shot 14, 15 may be lead or steel or other material. In any case, it is contained in the respective wads 16, 17 and, therefore, protected against contact with the inside of the barrel, which otherwise would become worn.

When the above-mentioned cartridge is fired, the first mass of shot 14 gives rise to a first pattern at a certain distance from the gun barrel, while the second mass of shot 15, held inside the second wad 17, continues in its trajectory as a single projectile beyond file first pattern. This continues until the second wad 17, thanks to its shape and the effect of the cross-wind, is forced to turn over, releasing the second mass of shot. In this way, a second pattern of shot is formed at a distance from the first, after the first has dispersed.

Figure 4:
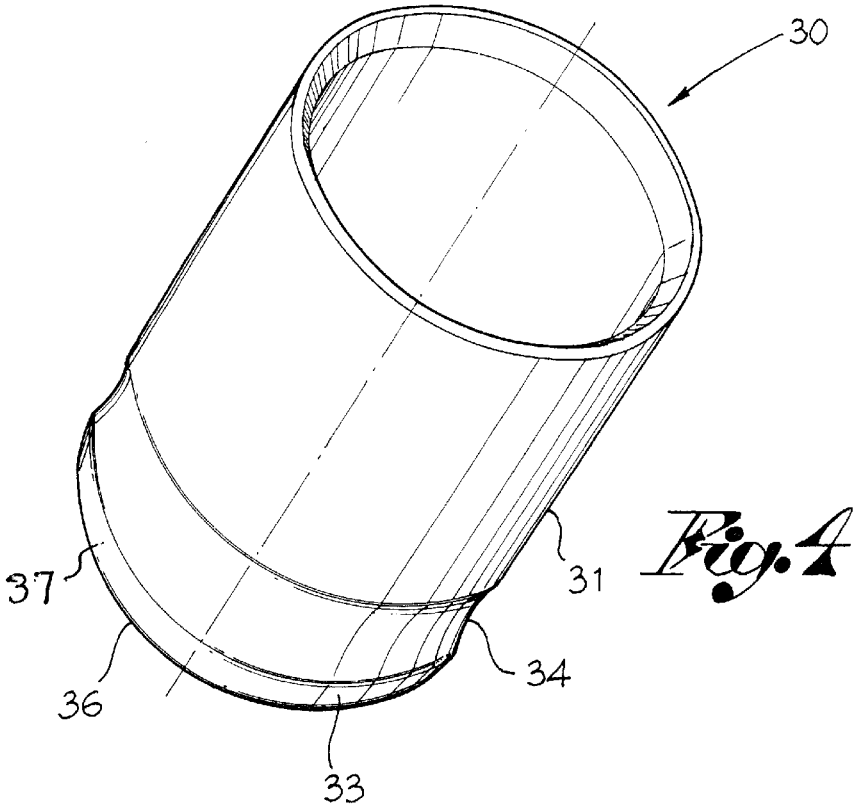
FIG. 4 is a perspective of another kind of wad that can be used in the invention.
Figure 5:
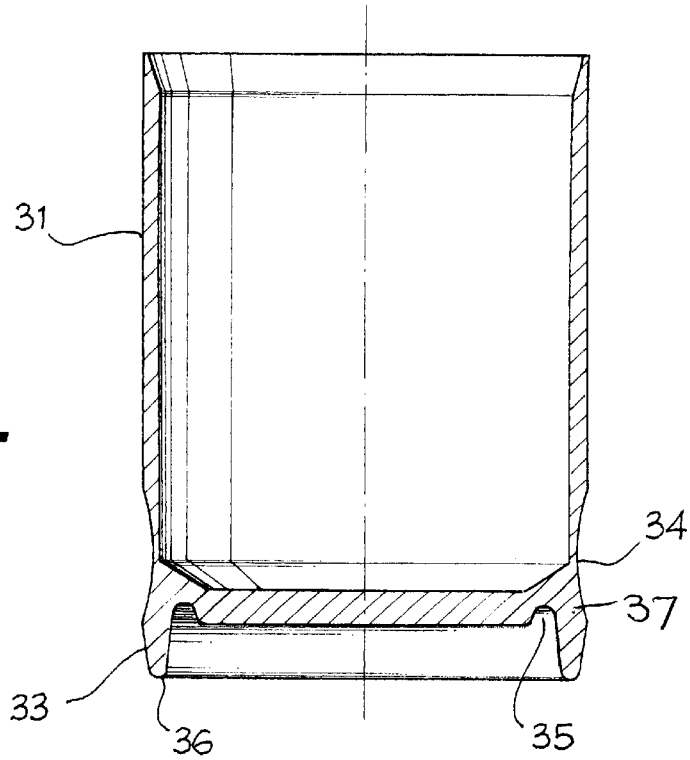
FIG. 5 is a lengthwise cross-sectional view of the wad in FIG. 4.

The second wad may be of the type shown in FIGS. 4 and 5, consisting of a container 30 with an annular edge 37 and a body 31 in plastic in the form of a cup with a base 32.

Externally, the body 31 has a chamfer 33 near to the base and a hollow 34 at the level of the end plate 32, which represents the area of greatest rigidity in the body 31. The external side of the end plate 32 has a groove 35 which is joined to the chamfered surface by means of a rounded connecting piece 36, made with a pre-determined radius.

The container wall in the drawing has a certain elasticity at the level of the end plate 32, thanks to the external hollow 34. Furthermore, when the cartridge is fired, the chamfer 33 ensures the container has a correct trajectory, without the slightest choking effect in the gun barrel, and the base hollow 35, catching the wind, facilitates the subsequent turning over of the container in order to release the shot inside, once a certain distance has been covered from the gun barrel.

Figure 6:
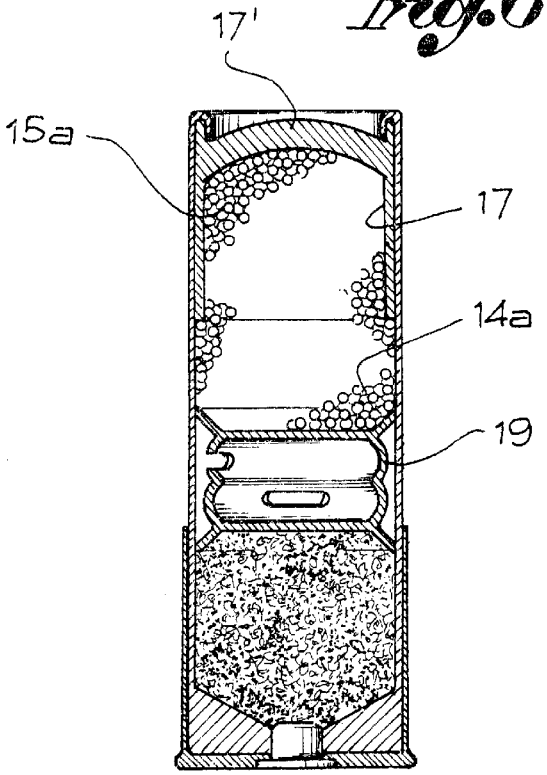
FIG. 6 is a lengthwise cross-sectional view of another version of the cartridge.

In the version shown in FIG. 6, the cartridge has the same prerogatives as the cartridge in FIG. 1, to the extent that it also contains two masses of shot 14*a,* 15*a,* which will form two patterns at different distances from the gun barrel. However, in this version, the first mass of shot 14*a* is not contained in a cup-shaped wad, but is free and pushed for firing by a two-way rotating wad 19, while the second mass of shot 15*a* is contained and moved by a wad 17 or 30, which flips over as in the first case. The result still gives the formation of a first pattern by the first mass of shot 14*a* and a more distant second pattern by the second mass of shot.

The distance between the patterns can be regulated by adjusting the ratios of the shot masses, and can vary from 10 to 15 m or more.

As the two-way rotating wad it is a good idea to use a container 40 as shown in FIGS. 7*a*–10, capable of reducing friction and reducing the cork-effect when it travels along the gun barrel during firing. The container 40 consists of a body 41, molded in plastic, with, externally, an intermediate tapering 42 and, internally, two cavities or chambers 43, 44 with an end plate 45 in common and open at the opposing ends, at the level of their respective mouths 43', 44'.

Figure 7A:
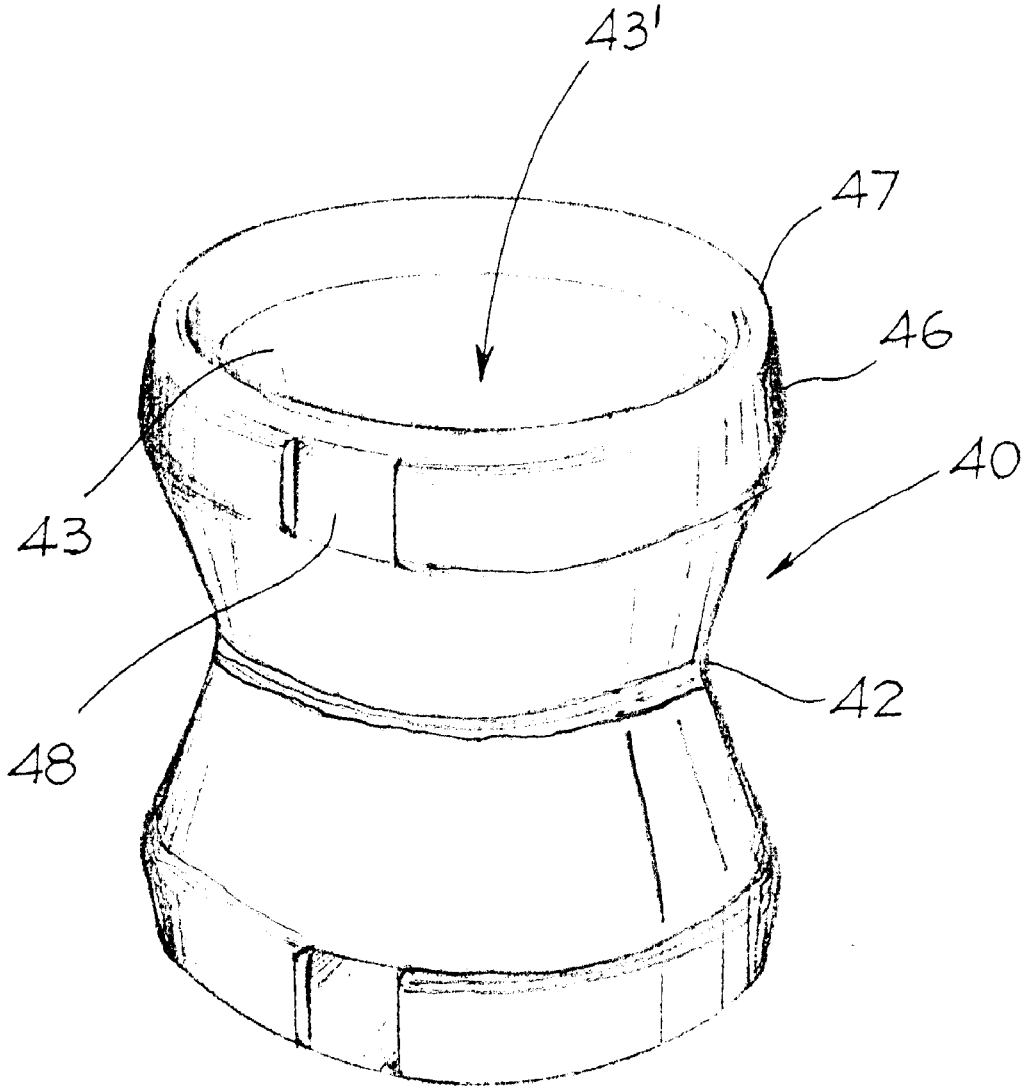
FIG. 7*a* is a perspective view of a wad for the type of cartridge shown in FIG. 6.
Figure 7B:
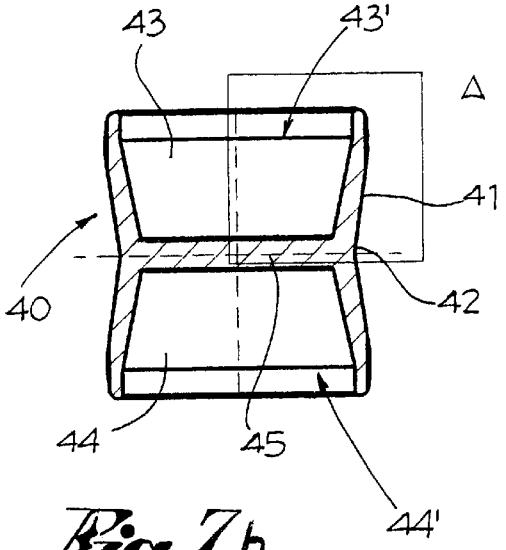
FIG. 7*b* is a cross-sectional view of the wad of FIG. 7*a;*
Figure 9:
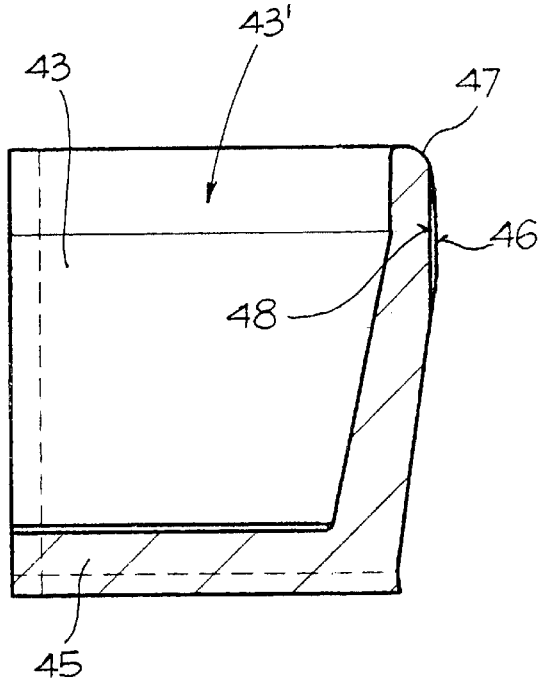
FIG. 9 is an enlarged detail cross-sectional view of a part of the wad highlighted as A in FIG. 7*b*.
Figure 8:
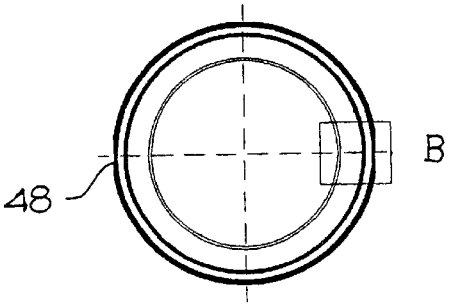
FIG. 8 is an end view of the wad of FIG. 7*b;*
Figure 10:
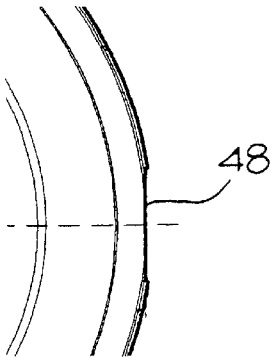
FIG. 10 is an enlarged detail view of a part of the wad highlighted as B in FIG. 8.

The external tapering 42 may derive from a double cone shape of the body 41, as shown in FIGS. 7*a* and 7*b,* or, alternatively, from a hollow or throat around the body.

In the case of the double cone shape, the external surface of the body widens from the intermediate tapering 42 towards the mouths 43', 44' of the cavities or chambers 43, 44. Near each of the mouths 43', 44', the outer wall of the body has a first concave chamfer 46 followed by a second chamfer 47 or by a radial connecting part which extends to the free end of the body, to the rim of the corresponding mouth.

At opposite ends of the body 41, outside it but still near the mouth of each cavity or chamber 43, 44, there are two levellings 48.

Ideally, each cavity or chamber 43, 44 is countersunk towards the mouth 43', 44', starting from the wall of the common end plate 45, which is placed at the level of the intermediate tapering 42. The two chambers may have a similar volume or different and are designed to house, one the propelling charge and the other a mass of shot.

The external shape of the container means that it has limited contact with the cartridge case into which it is inserted, thereby limiting the friction. The container, therefore comes into contact with the cartridge case and, when firing, with the gun barrel, only with its parts that have the widest diameter and which are located at the start of the first chamfers 46. Meanwhile, the levellings are designed to prevent the cork effect.

While specific embodiments of the invention have been shown and described in detail to illustrate the application of the principles of the invention, it will be understood that the invention may be embodied otherwise without departing from such principles.

What is claimed is:

1. A shot cartridge for guns, comprising:

a cartridge case having a primer;

a propellant disposed in said cartridge case proximate to said primer, shot disposed in said cartridge case;

a first element in contact with said shot to define a first mass of shot and moving with said first mass of shot at least a distance upon firing to define a first mass of shot firing pattern of said first mass of shot and to define a first mass of shot firing distance of said first mass of said shot for a given amount of said propellant;

a second element in contact with said shot to define a second mass of shot and moving with said second mass of shot at least a distance upon firing to define a second mass of shot firing pattern of said second mass of shot and to define a second mass of shot firing distance of said second mass of shot for a given amount of said propellant, said second mass of shot firing distance being greater than said first mass of shot firing distance and said first mass of shot firing pattern being different from said second mass of shot firing pattern, said first mass of shot being located near said propelling charge, said second mass of shot being located proximate to an exit mouth of said cartridge case, said second element being cup-shaped and having an end plate facing forward in the firing direction and having a side wall, said end plate, and said side wall defining an interior region containing said second mass of shot during initial trajectory, whereby said second element releases said second mass of shot to form said second mass of shot firing pattern, said first mass of shot being pushed by said first element for firing, said first element including a central tapering between a forward part and a reward part forming a two-way rotating wad and said second element turning over in flight to release said second mass of shot, said second element side wall having an external outer hollow at the level of the end plate and a tapering chamfer at a forward facing end, an external side of said end plate of said second element having a groove connected to said chamfer via a rounded connecting element of said a forward facing end of said side walls.

2. The cartridge according to claim 1, wherein said first mass of shot and said second mass of shot are equal or different in mass.

3. The cartridge according to claim 1, wherein said first mass of shot and said second mass of shot are different in volume, said second mass of shot being provided in a greater volume than said first mass of shot.

4. A shotgun cartridge, comprising:

a cartridge case having a primer;

a propelling charge contained in said cartridge case disposed proximate to said primer;

shot;

a first wad shot grouping element having a travel direction surface in contact with said shot, said travel direction surface acting on a first shot mass of said shot positioned in front of said first wad shot grouping element for at least some distance after exiting a barrel of a gun to define a first shot mass pattern; and a second wad grouping element having a continuous uninterrupted convex travel direction surface and a side surface extending rearwardly of said convex direction surface and an exterior surface extending forward to an annular edge, a forwardly extending annular surface extending between said convex travel direction surface and said annular edge, said forwardly extending annular surface and said convex travel direction surface define a cylindrical space, said convex travel direction surface having a forward convex region extending substantially fully to said annular surface with said forward convex region extending forward substantially to the forward extent of said annular edge, said side surface extending rearwardly a distance that is longer than a length of said annular surface with said side surface extending rearwardly defining a space containing a second shot mass of said shot for at least some distance after exiting the barrel of the gun.

5. The cartridge according to claim 4, wherein: said first wad shot grouping element has a first element side wall and rear portion forming a first element space, said first mass of shot being disposed in said first element space.

6. The cartridge according to claim 4, wherein: said first wad shot grouping element has a first element is a two way rotating wad having a cavity at a front and a cavity at a rear side, said two way rotating wad being disposed rearwardly of said first mass of shot with respect to a direction of firing.

7. A shot cartridge for guns, comprising:

a cartridge case having a primer;

propellant disposed in said cartridge case proximate to said primer;

shot disposed in said cartridge case;

a first element in contact with said shot to define a first mass of shot and moving with said first mass of shot at least a distance upon firing to define a first mass of shot firing pattern of said first mass of shot and to define a first mass of shot firing distance of said first mass of said shot for a given amount of said propellant;

a second element in contact with said shot to define a second mass of shot and moving with said second mass of shot at least a distance upon firing to define a second mass of shot firing pattern of said second mass of shot and to define a second mass of shot firing distance of said second mass of shot for a given amount of said propellant, said second mass of shot firing distance being greater than said first mass of shot firing distance and said first mass of shot firing pattern being different from said second mass of shot firing pattern, said first mass of shot being located near said propelling charge, said second mass of shot being located proximate to an exit mouth of said cartridge case, said second element being cup-shaped and having a base facing forward in the firing direction and having a side wall, said base and said side wall defining an interior region containing said second mass of shot during initial trajectory, whereby said second element releases said second mass of shot to form said second mass of shot firing pattern, said first mass of shot being pushed by said first element for firing, said first element being a two-way rotating wad, said second element turning over in flight to release said second mass of shot, said rotating wad having a plastic body having an intermediate tapering on an outside middle of said rotating wad, having two cavities or chambers with an end plate in common and open at opposite ends of the at the opposite ends of the plastic body, the plastic body having a first concave chamfer and a second concave chamfer which extends to an edge of the respective mouth and at least one side leveling.

* * * * *